United States Patent [19]

Rodriquez

[11] Patent Number: 4,489,807

[45] Date of Patent: Dec. 25, 1984

[54] CONTRACTIBLE ESCAPE LADDER

[76] Inventor: Ernest A. Rodriquez, 1258 Mt. Baker Hwy., Bellingham, Wash. 98225

[21] Appl. No.: 433,860

[22] Filed: Oct. 12, 1982

[51] Int. Cl.[3] ..... E06C 9/00

[52] U.S. Cl. ..... 182/96; 182/160

[58] Field of Search ..... 292/216, 221, 37; 182/94-96, 160

[56] References Cited

U.S. PATENT DOCUMENTS

| | | | |
|---|---|---|---|
| 301,785 | 7/1884 | Amsler-Laffon | 182/94 |
| 2,588,230 | 3/1952 | George | 70/363 |
| 2,957,539 | 10/1960 | Padlo | 182/94 |
| 2,962,113 | 11/1960 | Heimlicher et al. | 182/94 |
| 2,976,070 | 3/1961 | Gollbach | 182/96 |
| 4,165,112 | 8/1979 | Kleefeldt | 292/216 |
| 4,208,837 | 6/1980 | Black | 292/216 |

FOREIGN PATENT DOCUMENTS

| | | | |
|---|---|---|---|
| 2409001 | 9/1974 | Fed. Rep. of Germany | 292/216 |

*Primary Examiner*—Reinaldo P. Machado
*Assistant Examiner*—Alvin Chin-Shue
*Attorney, Agent, or Firm*—Hughes, Barnard & Cassidy

[57] ABSTRACT

A contractible escape ladder, configured for deployment from a collapsed configuration outwardly proximate a wall of a building structure to an escape configuration, is comprised of first and second ladder rails pivotal about a plurality of ladder rungs bridging same and nestable interiorly thereof and a latching member for maintaining the rails juxtaposed one to another in the collapsed configuration, including a latch release pin traversing the wall for deployment of the ladder from a position inside the building while maintaining the ladder secure from positions outside the building.

4 Claims, 7 Drawing Figures

CONTRACTIBLE ESCAPE LADDER

BACKGROUND OF THE INVENTION

1. Field of the Invention

The present invention relates, generally, to contractible ladders and, more especially, to such a ladder configured for deployment as an escape ladder proximate an exterior wall of a building from a position interiorly thereof.

2. Description of the Background Art

Safety consciousness is on the rise in the public; and particularly as respects the threat of fire or the like. Fire and/or smoke detectors are becoming commonplace fixtures in many private dwellings and are currently being compelled by local building codes as a requirement for public and/or rental buildings. Many such devices now incorporate emergency lighting to illuminate an escape path in the event of fire. However, in many cases routes through the building structure may be impassible, a problem oftentimes compounded by fear engendered by the emergency. Usually, escape from higher floors in a building by an exterior route is not facilitated, leaving the individuals either trapped within the building or with the ability to escape only by jumping—another perilous situation.

Of course, fire escapes are well known and are routinely associated with so-called "high-rise" buildings. It is far from customary, however, for private homeowners to include these escape provisions. Thus, there have been quite a number of proposals over the years for a collapsible ladder which might conveniently be secured to a building for escape, inter alia, from a fire. In the main, this class of escape ladder is constituted of a fixed rail attached to the building and a movable rail bridged by pivotal rungs whereby the ladder may be maintained in a collapsed configuration but may be deployed to an open, escape configuration should the need arise in the face of an emergency.

U.S. Pat. No. 4,245,717 is generally representative of this variety of escape ladder. It discloses a ladder comprised of two parallel uprights connected to one another by pivotally mounted rungs wherein the ladder is movable from a closed position in which the uprights abut one another to an open position in which the uprights are spaced by the rungs. Support devices are provided for maintaining the ladder in its open position, while a locking device is mounted on the ladder for holding it in its closed position. The latching device itself includes a locking member pivotably connected to the top of one of the uprights and a cooperating member connected to the top of the other. That preference for construction is one principally dictated by concern for unauthorized entry to the building structure via the ladder, since the latch is made accessible only by reaching outside a window near the ladder in order to move it from its closed position to its open position.

U.S. Pat. No. 4,243,119 is also exemplary of this general type of ladder. It too is comprised of a pair of ladder rails joined periodically by pivotal rungs so that it may move from a closed position to an open one for escape purposes. The fixed rail is formed with an ear having an aperture therein for registration with a corresponding aperture formed in the pivotal rail when in the closed configuration. A pin is inserted through the registering apertures for the purpose of maintaining the ladder in the latter form. Again, the latching member is disposed for operation by one attempting to exit the building and would, as with the foregoing, tend to minimize unauthorized use of the ladder by one attempting improperly to gain access to the building from the ground.

Yet another conceptually similar device is disclosed in U.S. Pat. No. 4,037,686. An escape ladder is described there to include a plurality of rungs spanning and pivotally connecting upright rails so that the ladder may be moved from a normally closed to an open, escape configuration. The ladder is maintained in its normal or closed position by a type of pin/registering aperture arrangement much like that discussed immediately above.

U.S. Pat. No. 3,575,263 is another concerned with folding fire escape ladders secured exteriorly of a building. It, like the foregoing, includes rails joined by pivotal rungs. A latch at the uppermost edge of the pivotal rail member is comprised of a flange having a lip for projection over the fixed rail member, which flange is biased downwardly about a pivot point in order to maintain that association. Deployment is achieved by tripping the latch on the opposite side of the pivot point against the biasing force of a spring.

Another type of ladder designed for collapsible storage and extension to an escape position is disclosed in U.S. Pat. No. 3,414,081. The overall ladder construction is generally as aforesaid while the latching member partakes of certain similarities as well. In this case a pivotable latch pin engages a notch on a latch arm provided with a lever extending from the other side of the pivot point. The pin projects outwardly of one of the ladder rails whereas the latching arm is disposed on the other. This device, as with the foregoing, requires deployment by reaching through an open window or the like and tripping the latching mechanism.

U.S. Pat. Nos. 3,025,923 and 278,301 share many of the same features noted above with regard to collapsible escape ladders. Positive latch members are included for securing the two ladder rails in a normal, collapsed configuration and, upon activation of the latching members, the rails separate to a deployed configuration for escape.

U.S. Pat. Nos. 258,186 and 830,678 are remarkable for constructions particularly adapted for multiple story buildings such as, e.g., apartment house structures. A single, collapsible ladder of the variety noted above is set outwardly proximate windows on each floor. A rope member is disposed along the length of the ladder for grasping by an individual at any floor and deployment of the ladder. The '186 patent is further noteworthy insofar as the main rope used for deployment is provided with secondary ropes passing interiorly of the building. Other patents of historical interest include U.S. Pat. Nos. 400,656, 295,127, 274,278, and 248,607. These additional patents add no further insight into an understanding of the construction or use of collapsible escape ladders over that more explicit above.

As is readily apparent from the preceding discussion, all manner and variety of collapsible ladder constructions have been proposed over the last century. However, despite continuing improvements in these devices, many drawbacks remain. For example, the vast majority of escape ladders within this class require deployment from a position exteriorly of the building. Two particular problems of note obtain when the latching mechanisms are associated directly on the ladder requiring manipulation from within the building by reaching through an open window or door. First, these latching members are prone to failure and lack of reliability for their intended purposes due to constant and oftentimes long exposure to the environment. Corrosion can cause failure or, equally probable, the corrosion product may interfere with the proper actuation of the latch. This is compounded by the second problem, the inconvenience of reaching through a window in order to move the ladder into an escape configuration. Understandably, the reasons necessitating escape give rise to a panic response exacerbated (and probably considerably) when confronted with a latching mechanism which has malfunctioned. Thus, there is considerable room for improvement on that approach.

The single patent reference noted above clearly intending deployment from within the building structure (i.e., U.S. Pat. No. 258,186) also admits of the ability to deploy the ladder from an exterior position by one attempting to gain unauthorized access to the building structure. This is an obvious drawback since little has been achieved by trading one source of emergency for another.

Continuing somewhat further along these lines, none of the ladder constructions noted above provides a truly failsafe approach in preventing unauthorized access to the building via the escape ladder. Even those devices specifically structured with an eye toward minimizing the ability for, e.g., a burglar to enter the building are lacking in many respects. For example, merely placing the latch out of reach from the ground does not suffice where it can be manipulated by, e.g., a pole or struck by a projectile and easily released.

Thus, the need exists to provide an improved, collapsible escape ladder which provides the advantages of those suggested in the prior art but which overcomes the drawbacks presented thereby.

SUMMARY OF THE INVENTION

The present invention advantageously provides a simple yet extremely reliable and durable collapsible escape ladder having a failsafe latching mechanism. The escape ladder of the present invention is further desirable for its ability to be deployed from a location interiorly of the building from which escape is desired while precluding substantially the ability to deploy the ladder from locations exteriorly thereof. The design of the instant ladder contributes to the additional benefit of considerably reduced tendencies toward seizing of the components due to prolonged exposure to the elements so that the ladder will remain ready for dependable use over extended periods. Accordingly, as will be seen in greater detail below, the escape ladder of the present invention advantageously provides the benefits heretofore sought in similar constructions while eliminating the undesirable aspects of previous approaches to this end.

The foregoing advantages are realized in one aspect in accordance with the present invention by a contractible escape ladder comprising first and second ladder rail means joined by pivotal ladder rung means permitting the rails to collapse into a normally closed configuration with the rungs nested interiorly of at least one of same and deployed to an escape configuration where the rails are separated and the rungs disposed in generally horizontal alignment in the sense of a customary ladder design. A latch operable only from the interior of the building structure secures the rails in the normally closed or collapsed configuration. In a highly preferred implementation, the latch is comprised of an overcenter latch plate/dog design cooperating with a biased latching plug having a detent formed on a shaft proximate the distal end thereof. The latch plate is rocked from a closed, overcenter position with respect to the dog by a pin extending through the wall of the building structure for deployment into the escape configuration. The plug is retained positively by the overcenter latch plate prohibiting deployment of the ladder from the outside of the building. Preferably, the entire latching mechanism outside the building structure is contained in a housing to ward off damage from the elements.

The foregoing, and other, advantages of the present invention and a fuller appreciation of its construction and mode of operation will be gained upon an examination of the following detailed description, taken in conjunction with the figures of drawing, wherein:

DETAILED DESCRIPTION OF THE INVENTION

The present invention relates, generally, to escape ladders and, more especially, to such a ladder configured for deployment from a collapsed or contracted position when not in use to an outwardly folded position respecting a wall of a building structure for use during escape therefrom. Accordingly, the present invention will now be described with reference to certain preferred embodiments within that context; albeit, those skilled in the art will appreciate that such a description is meant to be exemplary only and should not be deemed limitative.

Figure 1:
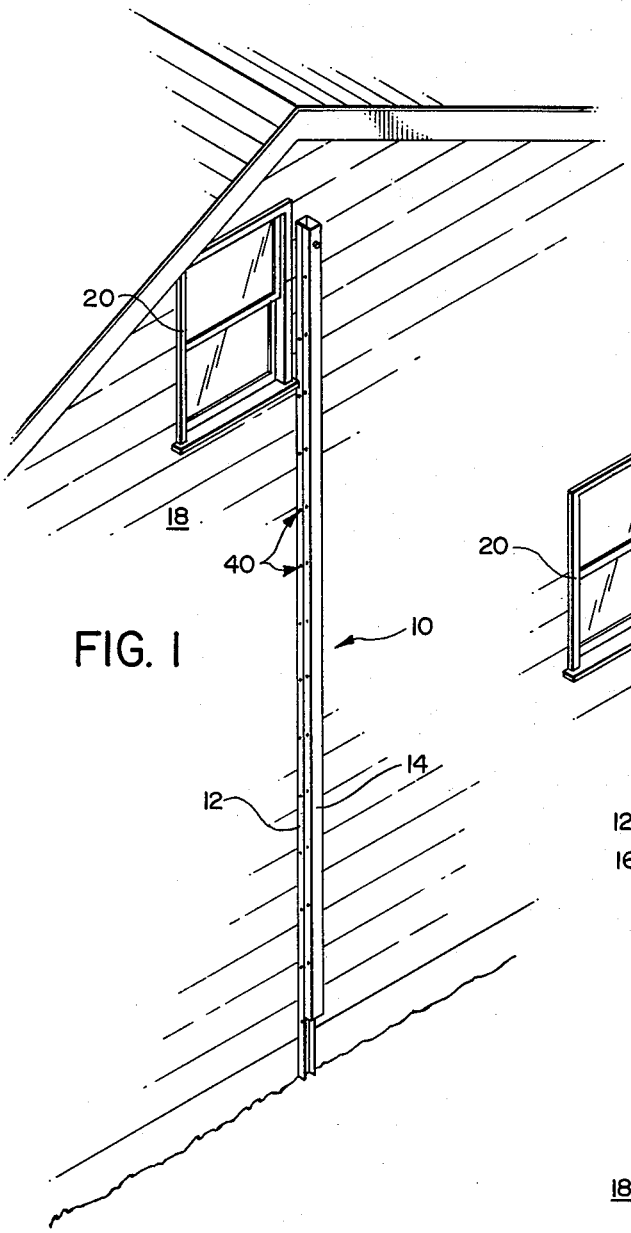
FIG. 1 is an isometric view of a building structure and a collapsible escape ladder in accordance with the present invention, shown in its normally closed configuration.
Figure 2:
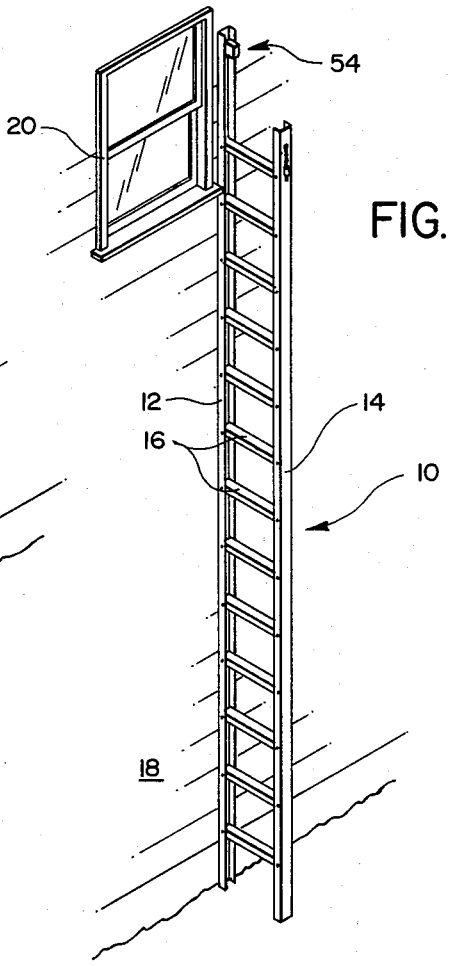
FIG. 2 is a view similar to FIG. 1, but showing the ladder in its deployed or escape configuration.

Turning to the figures of drawing, in each of which like parts are identified with like reference characters, FIGS. 1 and 2 show an escape ladder in accordance with the present invention, designated generally as 10, respectively in its normal or closed configuration and in its open or escape configuration. In this embodiment, the ladder 10 is shown to be comprised of an inner ladder rail 12 and an outer ladder rail 14 bridged by a plurality of ladder rungs 16. The inner rail 12 is secured, directly or indirectly, to an external wall 18 of a building structure proximate a window 20 comprising the escape route. Preferably, the inner rail 12 rests on the ground in order to provide added stability and support for the ladder 10 when in use. It is also preferred that the inner rail extend sufficiently above the lower sill of the window 20 in order to present at least one and preferably two rungs immediately adjacent the window to facilitate escape by providing an easily accessible step with some means for balancing support. By virtue of the pivotal deployment of the ladder 10 from the configuration of FIG. 1 to that of FIG. 2, the outer rail 14 is made shorter at the bottom end as best viewed in FIG. 1.

Figure 3:
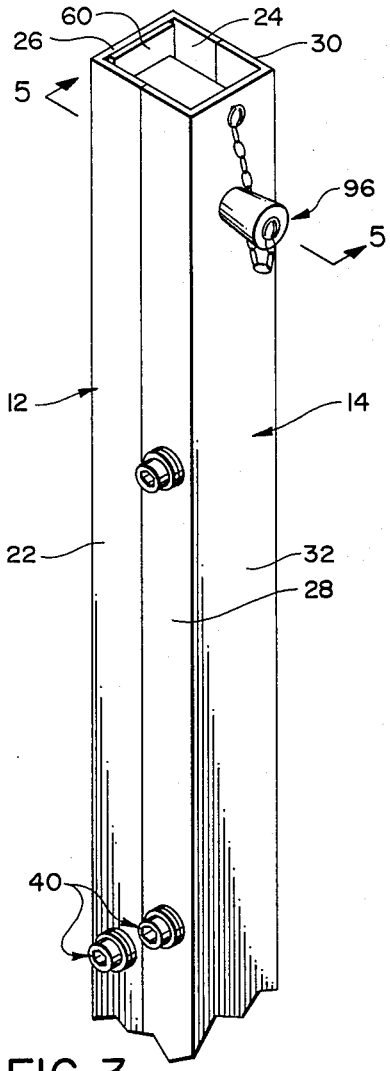
FIG. 3 is a fragmentary, isometric view of a ladder in accordance with the present invention, shown in its closed configuration.
Figure 4:
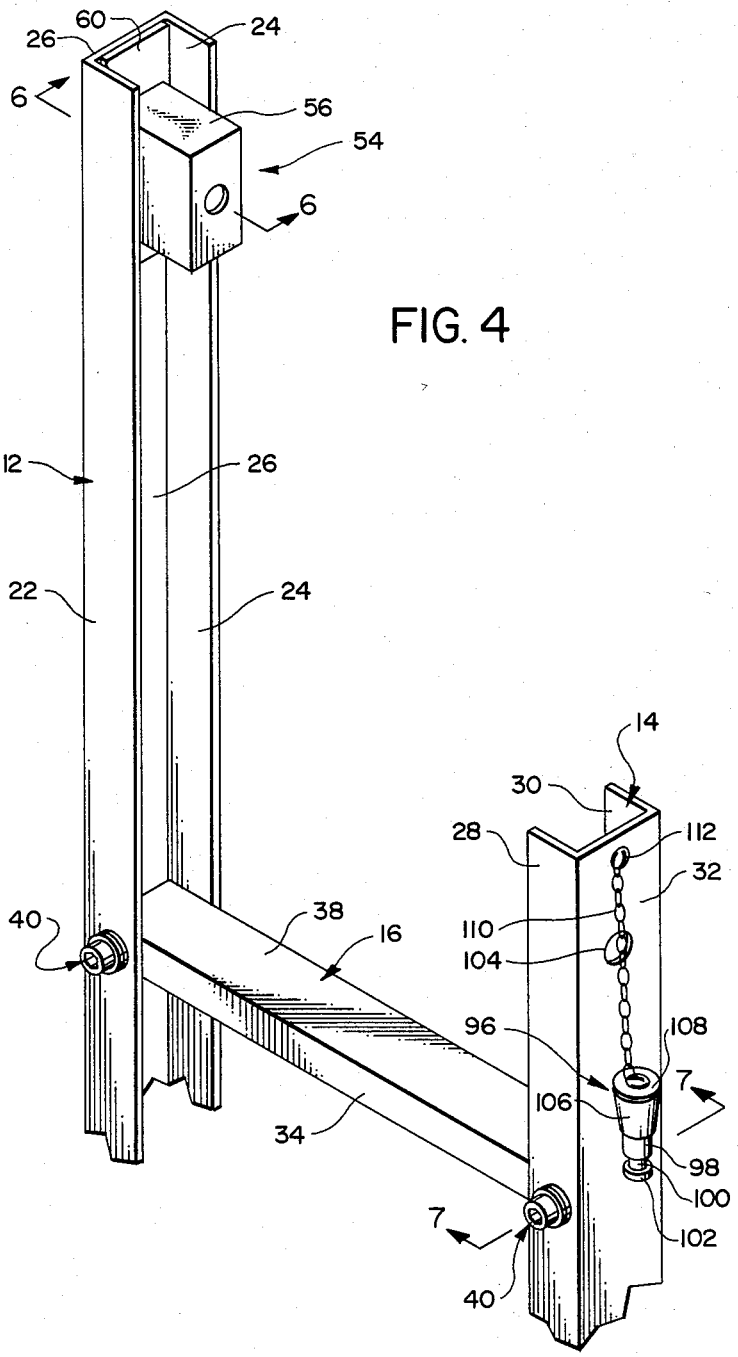
FIG. 4 is a fragmentary, isometric view, similar to FIG. 3, but showing the ladder in its deployed configuration.
Figure 7:
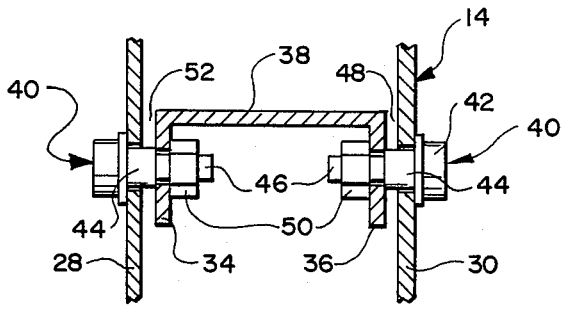

Each of the rungs 16 is disposed for pivotal movement with deployment of the ladder from the closed position of FIG. 1 to the open position of FIG. 2. As best viewed in FIGS. 4 and 7, each of these principal structural ladder components is formed from channel stock having a generally "U"-shaped cross section. Thus, the rail 12 is comprised of a pair of channel legs 22 and 24 spanned by a bridging leg 26. Likewise, the rail 14 is comprised of first and second channel legs 28 and 30 spanned by a bridging leg 32. In like vein, each rung 16 is comprised of channel legs 34 and 36 spanned by bridging legs 38. While other geometries might be used to equal advantage, these box channel sections are preferred for ease of procurement, good strength, and simplicity of construction. Furthermore, by appropriately dimensioning the rungs 16 vis-a-vis the rails 12 and 14, the former may be nested within the latter when the ladder 10 is in its folded configuration as viewed best, for example, in FIGS. 1 and 3. More specifically, the width of the channel of each rung 16 at its outer dimension is sized to be slightly less than the width of the channels for rails 12 and 14 measured at the inner dimension, as best viewed in FIG. 7. Each rung is then secured in place by pivotable fastener means 40; four such fastener members being shown in association with each rung in the exemplary embodiment illustrated in the figures of drawing. The most preferred pivotal fastener means 40 are shoulder bolts having a head 42 and a first shank 44 merging to a second shank 46 of reduced diameter thereby defining a shoulder or step 48. The shank 46 is ideally a threaded member for receiving a cooperative nut 50. The shoulder bolts 40 are inserted through apertures formed in the side channel legs of each of the rails and rung members to define pivotal axles about which the rungs may move during deployment of the ladder. The depth projection of the shank 44 and the width of the rungs 16 and cooperatively sized to yield a slight gap 52 between the edges of each rung and the rails to allow for this pivotal motion. This also allows the fixture members 40 to be secured very positively, capturing the channel legs 34 and 36 of each rung between the nut 50 and step or shoulder 48. The gap further tends to guard against a seizing of the rungs within the rails when the ladder is in its collapsed configuration, as might otherwise occur due to exposure to the environment over prolonged periods of time.

A latching member, designated generally as 54, serves to maintain the ladder 10 in its folded configuration (FIG. 1) in a failsafe manner; protecting the latch components against both the environment and anyone desiring to gain unauthorized entry to the building via the ladder. As best viewed in FIGS. 4, 5 and 6, the latch includes a housing 56 enveloping the latch components, secured to the inner rail 12 by fixture members 58 passing through flanges 60. The housing 56 contains a type of biased, overcenter latch mechanism provided by a latch plate 62 and cooperative dog 64. The latch plate 62 is fixed for rocking motion about a pivot point 66 in a central arm 68. First and second latching arms 70 and 72, respectively, are disposed outwardly proximate the central arm 68 to define first and second latching recesses 74 and 76, respectively. The dog 64 is likewise fixed for rocking motion about a pivot 78 allowing a dog arm 80 to rock into and out of engagement within the recess 76 by riding across the latch arm 72 from an overcenter position. Biasing means 82 is associated with the latch plate 62 and corresponding biasing means 84 is associated with the dog 64. As shown in the figures of drawing, the biasing means 82 is comprised of a spring pinned at a fixture 86 and extending into engagement with a biasing arm 88 on the plate 62. Likewise, the biasing means 84 is comprised of a spring pinned at a fixture 90 and extending to a similar biasing arm 92. A step 94 is formed in the housing in order to limit the amount of pivotal rotation permitted for the latch plate 62 and, hence, the dog 64.

A biased latching plug, designated generally as 96, mates with the latching mechanism to secure the outer rail 14, through the latch, to the inner rail 12 in the storage configuration of ladder 10. The latching plug 96 is comprised of a central shank 98 having a circumferential groove or detent 100 formed proximate its distal end yielding a knob 102 thereat. An aperture 104 is formed in the leg 32 of rail 14 to permit the shank 98 to pass therethrough with the detent 100 receiving the end of latch arm 70 and the knob 102 in cooperative engagement within the corresponding recess 74. The latching plug 96 further includes a biasing cushion member 106, shown to be in the form of a frustoconical section of a resilient polymeric material in butting engagement with a washer 108 secured to the shank 98. The length dimension of the cushion 106 is made to be slightly greater than the allowable space between washer 108 and leg 32 of the rail 14 when the plug 96 is latched so that it might be slightly compressed in that state. As noted in somewhat greater detail below, this aids considerably in the positive release of the latch 54 when the ladder is to be deployed. As a matter of convenience, a chain 110 secures the plug to the rail 14 at a fixture pin 112.

Figure 5:
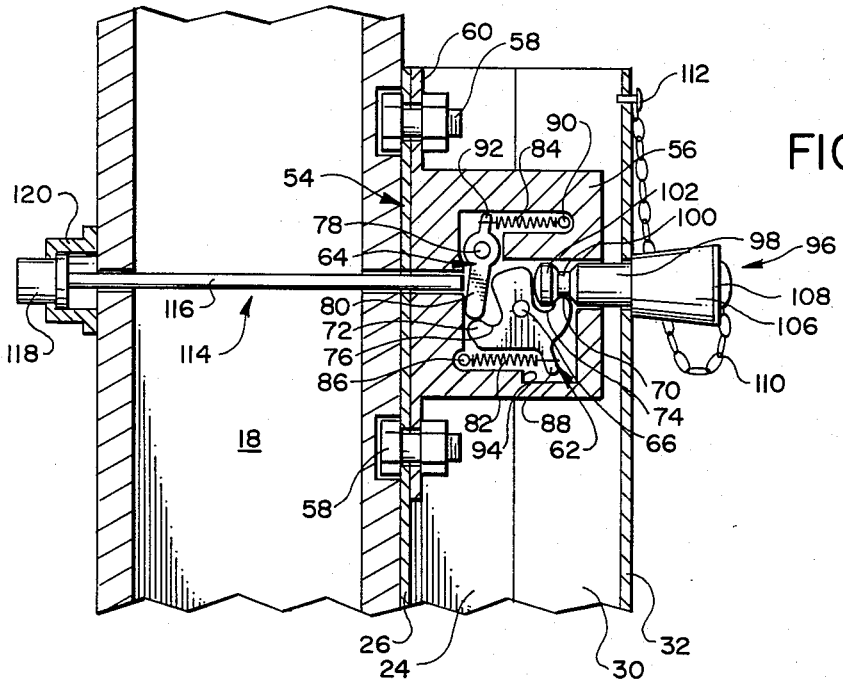
FIG. 5 is a sectional view taken substantially along the line 5—5 of FIG. 3, and showing both the construction of the latch and associated release mechanism.
Figure 6:
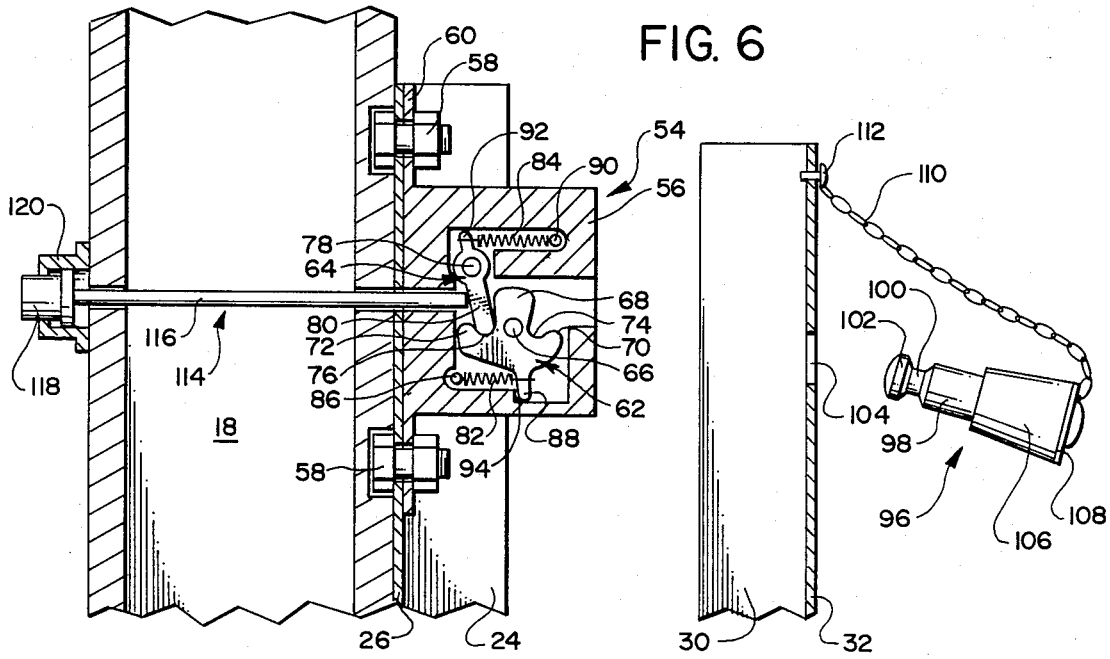
FIG. 6 is a fragmentary sectional view taken substantially along the line 6—6 of FIG. 4 and showing, in addition thereto, the initial movement of the outer ladder rail during deployment; and, FIG. 7 is a sectional view taken substantially along the line 7—7 of FIG. 4.

In the normally closed position, the shank 98 of the plug 96 is disposed through aperture 104 and the plug is pushed inwardly against the force of cushion 106 in order to rock the latch plate 62 into the position shown in FIG. 5. The dog arm 72 is forced overcenter into engagement with the edge of latch arm 72 by the central arm 68. The biasing means 84 helps insure this overcenter rocking motion. At that time, the latch arm 70 is forced within the detent 100 while the knob 102 is received within the recess 74. When in this position, any attempt to withdraw the plug 96 is resisted by the dog and the latch remains secure. Release of the latching mechanism for deployment purposes is achieved by a release pin means designated generally as 114. The release means includes a pin 116 disposed through the wall 18 of the building structure. A cap 118 projects outwardly into the interior space of the building within a housing 120 secured on the inside of the wall. Pin 116 passes through the rail 12 for engagement with the dog arm 80 of the latching member as shown in FIGS. 5 and 6. In the closed configuration of FIG. 5, the tip of pin 116 is inward of the dog arm and the cap 118 projects outwardly to its fullest extent within the housing 120. However, when it is desired to deploy the ladder to the escape configuration, the pin 116 is moved by slight depression of the cap 118, forcing the dog to pivot and assume the position shown in FIG. 6. Likewise, the latch plate pivots to release the plug 96 which, by virtue of the compression of resilient cushion 106, has a tendency to fly outwardly under a slight positive force. The step 94 prevents over rotation of the latch plate 62 so the plug may be reinserted to return the ladder 10 to its closed position. Hence, not only does the latching means 54 provide a generally failsafe latch, protected against both the elements and one who would attempt unauthorized entry to the building, it is very easily released by simple depression of the cap 118. The rail 14 pivots outwardly and downwardly about the rungs 16 either by force of gravity or at a touch of the hand. In sum, therefore, the ladder 10 provides the advantages of conceptually similar escape ladders while eliminating the significant drawbacks heretofore suffered by those desiring to have this type of escape route from, e.g., a dwelling.

While the invention has now been described with reference to certain preferred embodiments, those skilled in the art will appreciate that various modifications, changes, omissions and substitutions may be made without departing from the spirit thereof. For example, the ladder 10 is illustrated herein to be securely affixed directly to the wall 18 of the building structure. However, rather than, e.g., bolt the inner rail 12 directly to the wall, that rail might be secured at hinge members to permit rotation of the ladder into an orientation other than one generally normal to the outer wall 18 should that be desirable. In that case, rather than employ a stiff release pin means 116, a flexible pin communicating through the wall 18 with the latch dog 64 could be utilized allowing for a range of angular motions as might be appropriate. Accordingly, with such variations intended to be within the scope of the present invention, it is thus intended that it be limited solely by that of the claims granted herein.

What is claimed is:

1. A contractible escape ladder for disposition outwardly proximate a wall of a building structure and deployment from a collapsed configuration to an escape configuration, comprising:

a. first and second ladder rail means each having a generally U-shaped channel configuration comprised of opposed rail channel members joined by a bridging member defining an interior rail channel width dimension, wherein said first ladder rail means is formed for affixation to an exterior wall of a building structure with said second ladder rail means in outwardly pivotal relationship therewith;

b. a plurality of ladder rung means pivotally disposed in an array between said ladder rail means and secured thereto at opposing ends thereof, each of said rung means having a generally U-shaped channel configuration comprised of opposed rung channel members joined by a bridging member defining an exterior rung chanel width dimension, wherein said rung channel width dimension is measurably less than said rail channel width dimension;

c. axle means disposed through said rail channel members and the opposed ends of said rung channel members pivotally joining same together, said axle means including rung spacer means for establishing and maintaining a gap region intermediate the interior faces of said rail channel members and the exterior faces of said rung channel members; and, d. latching means for maintaining said ladder rail means juxtaposed in a collapsed configuration, operable to release said rail means for pivotal rotation about said rung means to an escape configuration from a location interiorly of said building while being secure from a location exteriorly thereof;

wherein said latching means includes overcenter latch means secured to said first ladder rail means for captured receipt of biased latch plug means having a shank disposed through said second ladder rail means to maintain said rails in said collapsed configuration and latch release means in operative engagement with said overcenter latch means across said wall, and further wherein said biased latch plug includes a biasing member urging said plug outwardly of said overcenter latch means and said second rail while sealing said shank against said second ladder rail means.

2. The escape ladder of claim 1, wherein said overcenter latch means comprises a pivotal latch plate having a central arm and first and second latch arms disposed on either side thereof defining first and second latch recesses, respectively and said shank of said biased latch plug means includes a detent proximate the distal end thereof receiving said first latch arm in latching engagement therewith in said collapsed configuration; said latching means further comprising a pivotal latch dog for overcenter engagement with said second latch arm in said collapsed configuration.

3. The escape ladder of claim 2, wherein said overcenter latch means further comprises release pin means extending through said wall into proximate engagement with said latch dog for pivotal movement thereof from said overcenter engagement into said second latch recess for deploying said ladder into said escape configuration.

4. The escape ladder of claim 2, wherein said biasing member comprises a compressible, resilient polymeric cushion compressed intermediate said second ladder rail means and the proximal end of said latch plug.

* * * * *